US005533570A

United States Patent [19]

Streich et al.

[11] Patent Number: 5,533,570

[45] Date of Patent: Jul. 9, 1996

[54] APPARATUS FOR DOWNHOLE INJECTION AND MIXING OF FLUIDS INTO A CEMENT SLURRY

[75] Inventors: Steven G. Streich; Ronald J. Crook, both of Duncan, Okla.; Richard R. Jones, Allen, Tex.

[73] Assignees: Halliburton Company, Duncan, Okla.; Atlantic Richfield Company, Plano, Tex.

[21] Appl. No.: 372,546

[22] Filed: Jan. 13, 1995

[51] Int. Cl.[6] ..... E21B 27/02

[52] U.S. Cl. ..... 166/153; 166/165; 166/169; 166/333.1

[58] Field of Search ..... 166/169, 162, 166/165, 310, 304, 153, 902, 333.1

[56] References Cited

U.S. PATENT DOCUMENTS

| | | | |
|---|---|---|---|
| 2,642,139 | 6/1953 | Bedford | 166/165 X |
| 2,852,080 | 9/1958 | Roach | 166/310 X |
| 2,859,827 | 11/1958 | Elkins et al. | 166/165 |
| 3,004,604 | 10/1961 | Limbocker, Jr. | 166/333.1 X |
| 3,020,961 | 2/1962 | Orr | 166/169 X |
| 3,104,715 | 9/1963 | Robinson, Jr. et al. | 166/162 |
| 3,199,596 | 8/1965 | Wood | 166/169 X |
| 3,259,192 | 7/1966 | Hyde | 166/150 |
| 4,361,187 | 11/1982 | Luers | 166/326 |
| 4,421,166 | 12/1983 | Cain | 166/162 |
| 4,499,951 | 2/1985 | Vann | 166/317 X |
| 4,771,635 | 9/1988 | Trevillion | 73/155 |
| 4,786,805 | 11/1988 | Priest | 250/260 |
| 4,809,776 | 3/1989 | Bradley | 166/153 |
| 4,809,778 | 3/1989 | Johnson | 166/310 |
| 4,846,279 | 7/1989 | Bruce | 166/310 |
| 5,002,127 | 3/1991 | Dalrymple et al. | 166/295 |

FOREIGN PATENT DOCUMENTS

| | | | |
|---|---|---|---|
| 1177452 | 9/1985 | U.S.S.R. | 166/285 |

OTHER PUBLICATIONS

Halliburton Services Sales & Service Catalog 43, pp. 2423–2451 (1985).

*Primary Examiner*—Hoang C. Dang
*Attorney, Agent, or Firm*—Craig W. Roddy; Stephen R. Christian; Neal R. Kennedy

[57] ABSTRACT

An apparatus for downhole injection and mixing of fluids into a cement slurry. The apparatus includes embodiments which either carry a fluid to the proper injection point in a wellbore or maintain it at the proper injection point until activated. In a first embodiment, the apparatus is characterized as a cementing plug having a fluid holding chamber therein. When the plug is pumped downwardly in the wellbore, the fluid in the chamber is flowed out of the chamber and mixed with the cement slurry by a venturi effect. In a second embodiment, the apparatus is characterized by a casing portion having a fluid holding chamber therein. A solenoid valve controls communication of the chamber with the well annulus, and fluid flow through the well annulus causes the fluid in the chamber to be flowed outwardly by a venturi effect. The second embodiment includes a casing shoe disposed below the fluid holding chamber. A third embodiment is disclosed which is substantially the same as the second embodiment except that it utilizes a casing cementing valve rather than a casing shoe. Methods of utilizing the apparatus to cement a well casing and mix a fluid, such as an accelerant, with the cement slurry are also disclosed.

20 Claims, 5 Drawing Sheets

APPARATUS FOR DOWNHOLE INJECTION AND MIXING OF FLUIDS INTO A CEMENT SLURRY

BACKGROUND OF THE INVENTION

1. Field of the Invention

This invention relates to apparatus for use in cementing of the outer casing annulus of a wellbore, and more particularly, to an apparatus which carries an accelerating fluid to the proper injection point or maintains the fluid at the proper injection point until the apparatus is activated.

2. Description of the Prior Art

Cementing of casing into a wellbore is well known in the art. Cement is pumped into the well casing through a casing shoe or a cementing valve installed in the casing so that the cement is positioned in the desired zone. Depending upon conditions, it may be necessary to mix additives with the cement to retard setting time, accelerate setting time, control fluid loss in the cement, gel the cement, reduce the slurry density, lighten the slurry or increase its weight, increase its mechanical strength when set, reduce the effect of mud on the cement, improve its bonding, or to effect more than one of the above purposes, as well as others. To do this, additives are mixed with the cement slurry.

Additives have been mixed on the surface and then pumped with the cement into the well. Alternatively, a portion of the cement may be pumped, additive pumped after that, and more cement pumped, etc. For example, in order to accelerate the setting up of a cement column in a subterranean well, it is necessary to inject certain chemicals, such as accelerators, into the cement slurry at the proper time, at the proper place and in the proper proportions. This procedure has the obvious drawback that an additive starts working as soon as it contacts the cement, and it is never certain that the mixed cement and additive will reach the desired location at the correct time which may result in the cement setting up too soon or too late.

Since the cement slurry must remain pumpable for a specified period of time, it is desirable to inject the chemicals into the cement slurry downhole rather than at the surface during mixing. This allows the accelerator to act only when desired and not set up the cement too soon. Devices for carrying out such injection have been developed. One such device is shown in U.S. Pat. No. 4,361,187 which discloses a downhole mixing valve for use in cementing, fracturing or other treatment of a well. This valve is generally mounted on a pipe string which is run into the well casing. This has worked well, but it does require an additional trip with the pipe string which increases costs and the time of the cementing job.

The apparatus of the present invention solves the problems of the previous devices in that it includes a mechanism for either carrying the accelerator to the proper injection point or maintaining the accelerator at the proper injection point until the device is activated. The accelerator may then be injected into the fluid without need of an additional trip with a pipe string.

SUMMARY OF THE INVENTION

In one embodiment of the apparatus for downhole injection of mixing of fluids of the present invention, the chemical, such as an accelerator, is carried into the well inside a plug. The plug may be released into the cement slurry at the proper time to allow the accelerator to be injected into only a selected portion of the cement slurry. A venturi effect is set up through the inside of the plug once the plug lands on the bottom plug. A valve sleeve is moved to an open position upon impact, thus allowing flow of the accelerator into the cement slurry by virtue of a pressure differential set up by the venturi effect.

In other embodiments of the apparatus, the chemical is located in an integral part of the casing string that is to be cemented into the well. The accelerator is thus maintained at its predetermined location and then activated when desired. As with the other embodiment, a venturi effect will cause the accelerator to flow into the cement slurry stream. In these embodiments, a pressure differential is caused by the flow of cement in the well annulus around the outside of the casing string.

Generally, the present invention may be described as an apparatus for injecting fluid into a wellbore wherein the apparatus comprises housing means for defining a chamber therein and a port in communication therewith. The chamber is adapted for holding a first fluid, such as a cement accelerator, therein. The apparatus further comprises valve means for opening the port in the housing such that the first fluid is free to flow out of the chamber through the port in response to flow of a second fluid, such as a cement slurry, thereby, and volume reduction means for reducing a volume of the chamber as the first fluid flows through the port. The flow of the second fluid causes a venturi effect such that a pressure differential forces the first fluid out of the chamber. Alternatively, the chamber may be pressurized. Preferably, the apparatus further comprises an orifice disposed in the port to control the flow rate of the first fluid.

In a first preferred embodiment, the housing means is characterized as a housing of a plug which may be pumped down the wellbore during a cementing operation. The housing defines a flow passage through which the second fluid may be flowed, and the first fluid flows into the flow passage when the port is opened by the valve means.

The valve means may comprise a valve sleeve disposed on the housing means and movable from a first position covering the port and a second position wherein the port is uncovered. This valve sleeve is actuated when the plug reaches the bottom of the casing string and contacts another cementing plug therebelow. A shear means for shearably holding the valve sleeve in the first position is preferably included.

In other embodiments, the housing means is characterized by a portion of the well casing itself which is disposed in the wellbore. In this embodiment, the first fluid flows into the well annulus between the casing and the wellbore when the port is opened by the valve means. The valve means may comprise a solenoid valve which is actuated by a microprocessor means for controlling the solenoid valve in response to a signal. This signal may be a pressure signal or may be a signal in response to a cementing plug pumped to a specific location.

In a preferred embodiment, the volume reduction means is characterized by an inflatable bag disposed in the chamber and in communication with the port. When the second fluid flows past the port, a pressure differential is created which causes the bag to collapse and forces the first fluid out into the flow of the second fluid. Alternatively, the chamber may be pressurized. In an alternate embodiment of the volume reduction means, a piston is slidably disposed in the chamber and moves in response to a pressure differential thereacross to force the first fluid out into the flow of the second fluid.

Methods of injecting accelerant into a cement slurry in a cementing operation are also disclosed utilizing the apparatus of the present invention.

Numerous objects and advantages of the invention will become apparent as the following detailed description of the preferred embodiments is read in conjunction with the drawings which illustrate such embodiments.

DESCRIPTION OF THE PREFERRED EMBODIMENTS

First Embodiment

Figure 1:
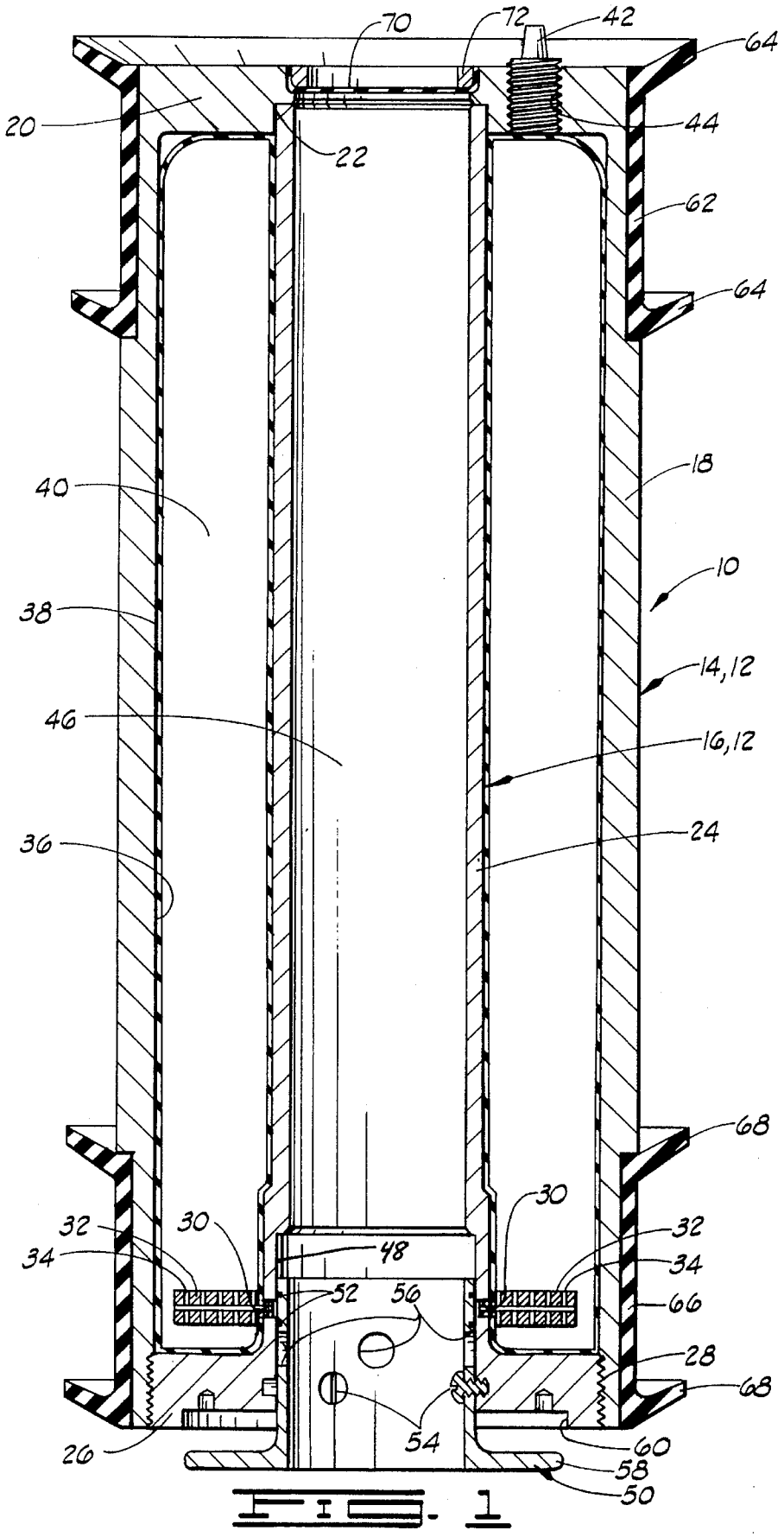
FIG. 1 shows the apparatus for downhole injection and mixing of fluids into a cement slurry of the present invention embodied as a cementing plug for carrying a fluid, such as a cement accelerator, to a proper injection point in a well.

Referring now to the drawings, and more particularly to FIG. 1, a first embodiment of the apparatus for downhole injection and mixing of fluids into a cement slurry of the present invention is shown as a plug, generally designated by the numeral 10. Plug 10 comprises a housing means characterized by a housing 12 formed by an outer case 14 and an inner mandrel 16.

Case 14 has a substantially cylindrical wall portion 18 with an upper end 20 extending radially inwardly therefrom. End 20 defines an opening 22 therein.

Mandrel 16 has a substantially cylindrical inner wall portion 24 with a lower end 26 extending radially outwardly therefrom. The upper end of mandrel 16 fits in opening 22 in case 14, and lower end 26 of the mandrel is connected to the case at threaded connection 28.

A plurality of ports 30 are defined radially through wall 24 of mandrel 16 adjacent to lower end 26. Ports 30 may also be defined as housing ports 30. An orifice block 32 defining a plurality of orifices 34 therein is preferably disposed in each housing port 30.

It will be seen that case 14 and mandrel 16 of housing 12 define a chamber 36 within the housing which is in communication with ports 30. A volume reduction means, such as an elastomeric bag 38, is disposed in chamber 36. Bag 38 substantially fills chamber 36. Thus, bag 38 defines a variable volume cavity 40 therein. Orifice blocks 32 are actually disposed within bag 38 such that they are in communication with cavity 40. At the upper end of bag 38 is a filling stem 42 which extends outwardly through a hole 44 defined in upper end 20 of case 14. Filling stem 42 may include a back check valve of a kind known in the art such that bag 38 may be filled with a first fluid, such as a cement accelerator.

Mandrel 16 defines a central opening 46 therethrough which, as will be further described herein, defines a flow passage through housing 12. At the lower end of central opening 46 is a bore 48.

A valve sleeve 50 is disposed in bore 48, and when in the first position thereof shown in FIG. 1, covers housing ports 30. A sealing means, such as a pair of O-rings 52, provide sealing engagement between valve sleeve 50 and mandrel 16 on longitudinally opposite sides of ports 30.

A shearing means, such as a plurality of shear pins 54, holds valve sleeve 50 in the first position shown in FIG. 1.

As will be further described herein, when shear pins 54 are sheared, valve sleeve 50 is free to slide upwardly within bore 48 of mandrel 16. At this point, a plurality of valve ports 56 in valve sleeve 50 are moved into alignment with corresponding housing ports 30. Also, a radially outwardly extending flange 58 of valve sleeve 50 is moved into a recess 60 defined on the bottom of lower end 26 of mandrel 16. In this position, it will be seen that fluid held in cavity 40 of bag 38 (and thus held within cavity 36 of housing 12) is placed in communication with central opening 46.

On the upper outer end of case 14 is a wiper sleeve 62 having a pair of wiper rings 64 extending radially outwardly thereon. At the lower outer end of case 14 is another wiper sleeve 66 having a pair of wiper rings 68 extending radially outwardly thereon. Wiper sleeve 62 may be identical to wiper sleeve 66.

A diaphragm 70 held in place by a diaphragm retainer 72 is disposed in upper end 20 of case 14. It will be seen that diaphragm 70 initially closes central opening 46 to fluid flow.

Figure 2:
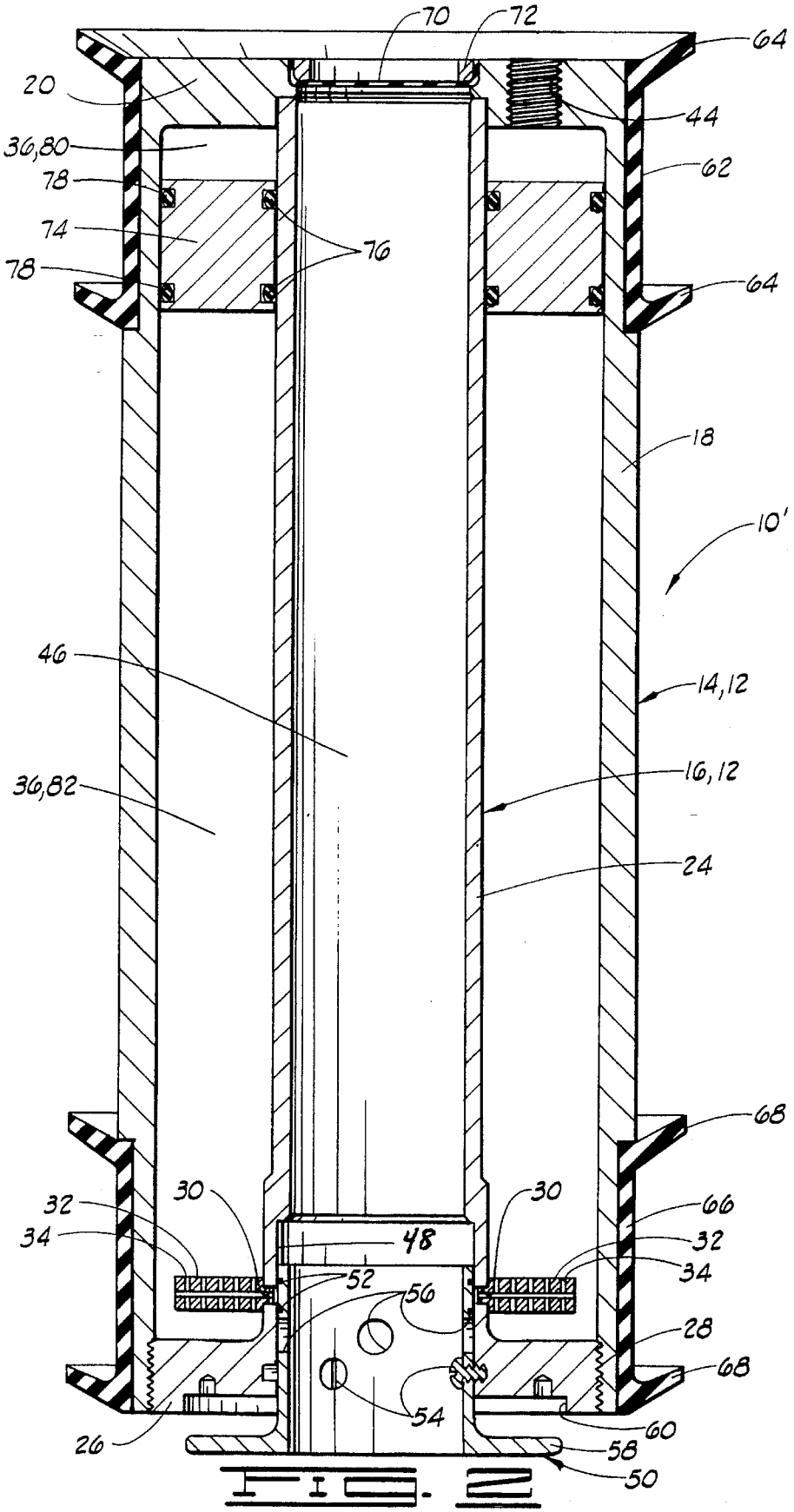
FIG. 2 shows an alternate embodiment of the plug.

Referring now to FIG. 2, an alternate embodiment plug 10' is shown which is similar in many respects to plug 10 of FIG. 1. However, rather than using a bag, the volume reduction means is characterized in plug 10' as a sliding piston 74. A sealing means, such as a pair of O-rings 76 provide sealing engagement between piston 74 and mandrel 16. Another sealing means, such as a pair of O-rings 78, provide sealing engagement between piston 74 and case 14. It will thus be seen that chamber 36 is divided into a variable volume upper chamber 80 and a variable volume lower chamber 82 by piston 74.

OPERATION OF THE FIRST EMBODIMENT

Figure 3:
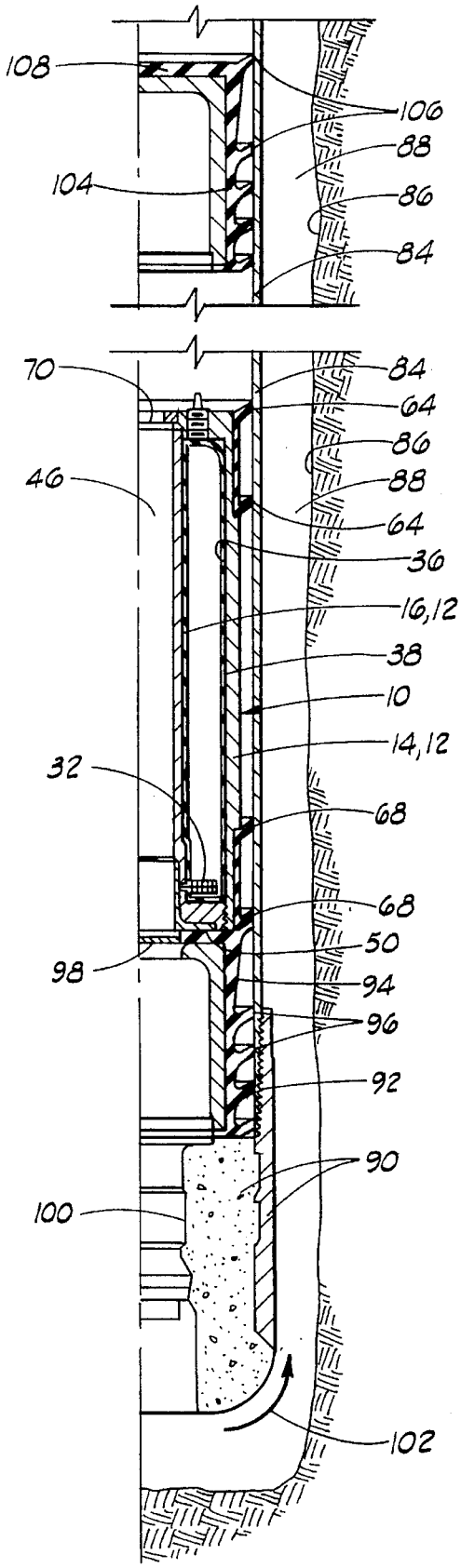
FIG. 3 illustrates the plug of FIG. 1 in use as part of a plug set for a cementing operation in a wellbore.

Referring now to FIG. 3, the operation of the first embodiment of the present invention will be discussed. A casing string 84 is disposed in a wellbore 86 with an annulus 88 defined therebetween. The lower end of casing string 84 is attached to a casing shoe 90 of a kind known in the art at threaded connection 92.

Once it is desired to begin the operation for cementing outer casing annulus 88, a first or bottom plug 94, of a kind known in the art, is pumped downwardly through casing string 84. A plurality of wiper rings 96 on bottom plug 94 wipe the inside surface of casing string 84 free of the drilling mud or other fluids that were already present therein and sealingly separates the mud from the cement above the bottom plug. A diaphragm 98 is disposed in bottom plug 94 to keep the cement and mud from mixing as the bottom plug is pumped down. Eventually, bottom plug 94 will come to rest on float shoe 90. Additional pressure applied to bottom plug 94 will cause diaphragm 98 to be ruptured so that the cement can flow through the bottom plug and thus through opening 100 in casing shoe 90 and upwardly into annulus 88 as indicated by arrow 102.

After an initial, desired amount of cement has been pumped down casing 82 and into annulus 88 as described, plug 10 is then pumped downwardly on top of this cement. Above plug 10 is another desired amount of cement. Diaphragm 70 in plug 10 insures that the pressure applied to the plug will continue to force it downwardly.

Eventually, plug 10 will reach lower plug 94. At this point, the bottom of valve sleeve 50 will contact the top of bottom plug 94. This will cause an upward force on valve sleeve 50, shearing shear pins 54 to move the valve sleeve upwardly to its second position in which valve ports 56 are aligned with housing ports 30, as previously described. Also, continued pressure applied on top of plug 10 will cause diaphragm 70 to be ruptured so that cement will flow downwardly through central opening 46. It will be seen by those skilled in the art that the velocity of the cement slurry through central opening 46 is greater than it is through the larger diameter casing string 84. This causes a venturi effect across housing ports 30 and pressure differential above and below plug 10 which is thus applied across bag 38. This causes the bag to collapse, reducing the volume thereof and forcing the accelerant in the bag outwardly through housing ports 30 and aligned valve ports 56 into central opening 46 to be mixed with the cement slurry. Thus, the accelerant is mixed with the cement only at the proper accelerant injection point.

As an alternative or supplement to the venturi effect just described, the first liquid in cavity 40 of bag 38 may be pressurized to insure that it flows outwardly when valve sleeve 50 is opened. Also, the portion of chamber 36 outside bag 38 may be pressurized to help insure that the fluid in the bag flows outwardly and the bag collapses.

As a final step in the cementing process, a third or top plug 104 is pumped downwardly on top of the cement. Wiper rings 106 wipe the cement as top plug 104 moves downwardly. Upper end 108 of top plug 104 is closed so that there is no mixing between the cement slurry below top plug 104 and the fluid pumped thereabove.

Eventually, top plug 104 will come to rest on plug 10 to complete the cementing operation.

With alternate plug 10', the operation is substantially identical, except that the pressure differential caused by the increased fluid flow through central opening 46 and the corresponding venturi effect is applied to piston 74, resulting in the piston being moved downwardly to reduce the volume of lower chamber 82 and increase the volume of upper chamber 80. The accelerant in lower chamber 82 is thus displaced outwardly through aligned housing ports 30 and valve ports 56 to mix with the cement slurry flowing through central opening 46.

Again, as an alternative or supplement to the venturi effect, pressurization may be utilized in alternate plug 10'. For example, upper chamber 80 may be pressurized to assist in forcing piston 74 downwardly.

Second Embodiment

Figure 4A:
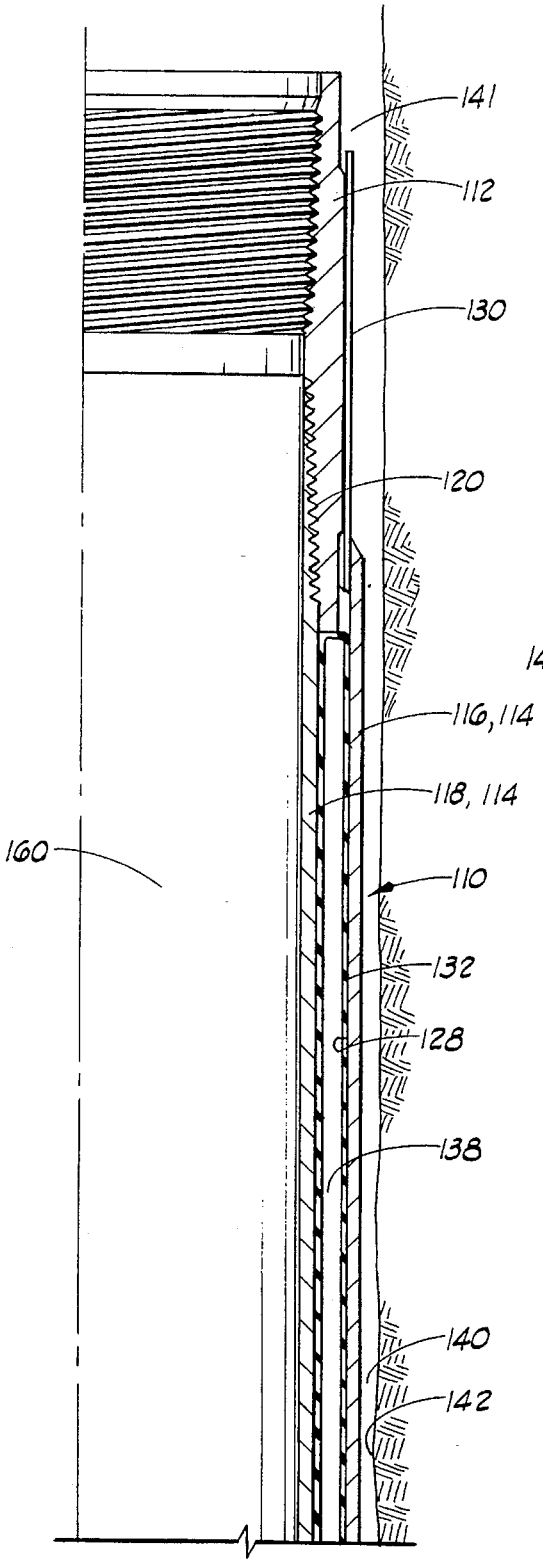
FIGS. 4A and 4B present a longitudinal cross section of a second embodiment of the invention in which the accelerant is maintained in a portion of a casing string.
Figure 4B:
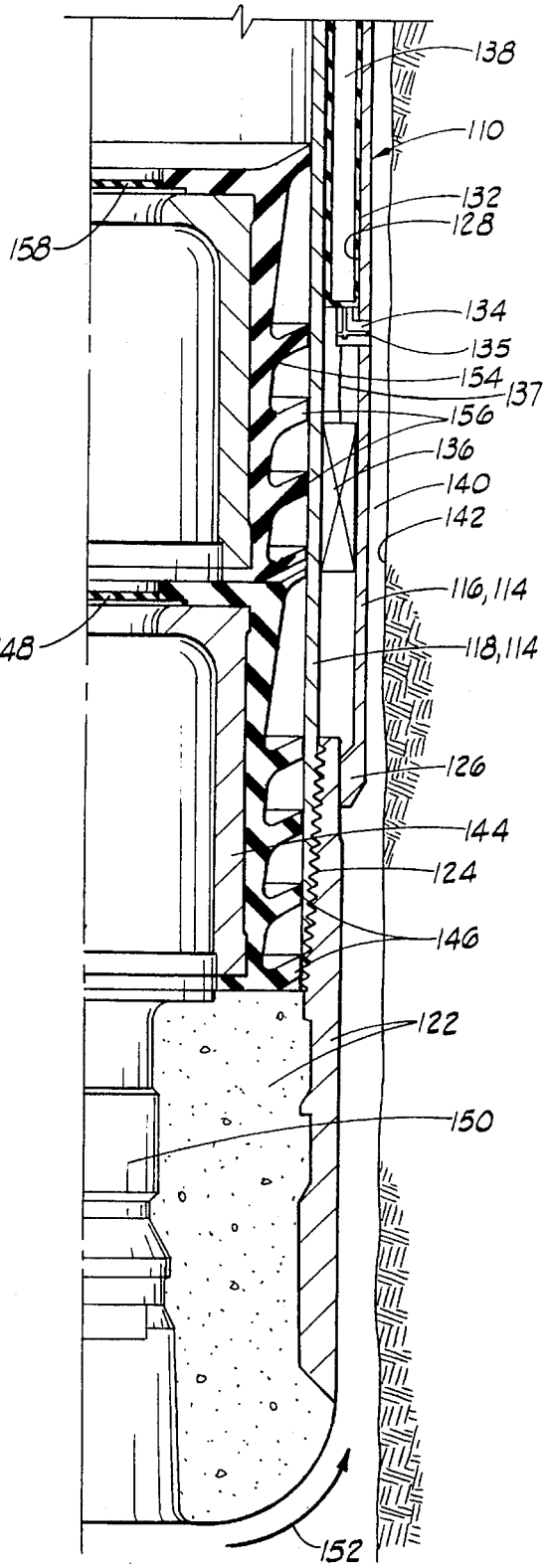

Referring now to FIGS. 4A and 4B, a second embodiment of the apparatus for downhole injection and mixing of fluids into a cement slurry of the present invention is shown as a casing portion 110 of a casing string 112.

Casing portion 110 comprises a housing 114 formed by an outer case 116 and an inner mandrel 118 which is connected to the outer case at threaded connection 120 at the upper end. The lower end of mandrel 118 is connected to a casing shoe 122 at threaded connection 124. Casing shoe 122 is similar to casing shoe 90 shown in the first embodiment and is of a kind known in the art. Lower end 126 of case 116 fits closely around the upper end of casing shoe 122.

Case 116 in mandrel 118 define an annular chamber 128 within housing 114. A vent tube 130 is in communication with chamber 128 and well annulus 141.

In the preferred embodiment, an elastomeric bag or bladder 132 is disposed in chamber 128 in a manner similar to bag 38 in first embodiment plug 10, although a piston arrangement similar to plug 10' could also be used. The lower end of bag 132 is connected to a solenoid valve 134 which is normally closed. A microprocessor 136 with a battery pack is connected to solenoid valve 134 by a connector 137. Microprocessor 136 is adapted for controlling solenoid valve 134 and opening it in response to a signal as will be further described herein. When solenoid valve 134 is opened, a cavity 138 within bag 132 is opened to well annulus 140 defined between casing string 112 and wellbore 142. A plurality of orifices 135 are in communication with solenoid valve 134.

Operation of the Second Embodiment

Still referring to FIGS. 4A and 4B, during a cementing operation a first or bottom plug 144 is pumped down casing string 112. Wiper rings 146 on bottom plug 144 wipe the inside surface of well casing 112 free of the drilling mud or other fluids that were already present therein and sealingly separate the mud from the cement above bottom plug 144. Eventually, bottom plug 144 comes to rest against float shoe 122. Additional pressure applied will rupture a diaphragm 148 in bottom plug 144 thereby allowing the cement slurry to flow downwardly through the bottom plug and through opening 150 of casing shoe 122 into well annulus 140 as indicated by arrow 152.

After the desired amount of cement has been pumped, a second or intermediate plug 154 is pumped down casing string 112. A plurality of wiper rings will wipe the inside surface of casing string, and a diaphragm 158 insures that a pressure differential across second plug 154 exists so that the plug will be pumped downwardly. Microprocessor 136 senses a signal indicating the landing of second plug 154 on bottom plug 144 and actuates solenoid valve 134 to place orifices 135 in communication with well annulus 140. Additional cement is pumped downwardly to rupture diaphragm 158.

The cross-sectional area of well annulus 140 is relatively smaller compared to that of well annulus 141 so that the fluid flow through well annulus 140 is relatively faster than the fluid flow through well annulus 141. This increased fluid flow creates a venturi effect with a pressure differential across casing portion 110. This collapses bag 132 so that the accelerant in cavity 138 in the bag (and thus in cavity 128) is forced outwardly into the cement slurry stream flowing upwardly through well annulus 140.

As an alternative or supplement to the venturi effect, the fluid in cavity 138 of bag 132 may be pressurized or chamber 128 may be pressurized outside bag 132 to cause the first fluid to flow out of the bag.

When the additional desired amount of cement has been pumped, a third or top plug (not shown) may be pumped downwardly in a manner substantially identical to that shown in FIG. 3 for the first embodiment, thus completing the cementing operation.

Third Embodiment

Figure 5A:
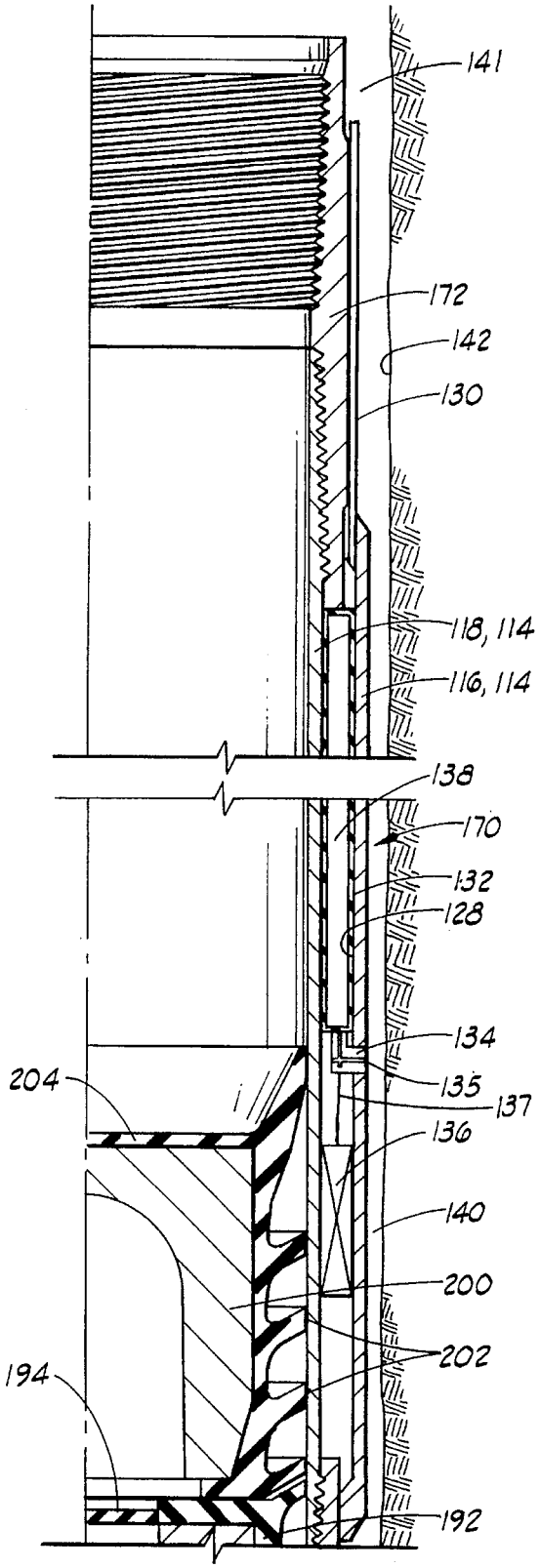
FIGS. 5A and 5B show a modified version of the apparatus of FIGS. 4A and 4B incorporating a cementing valve.
Figure 5B:
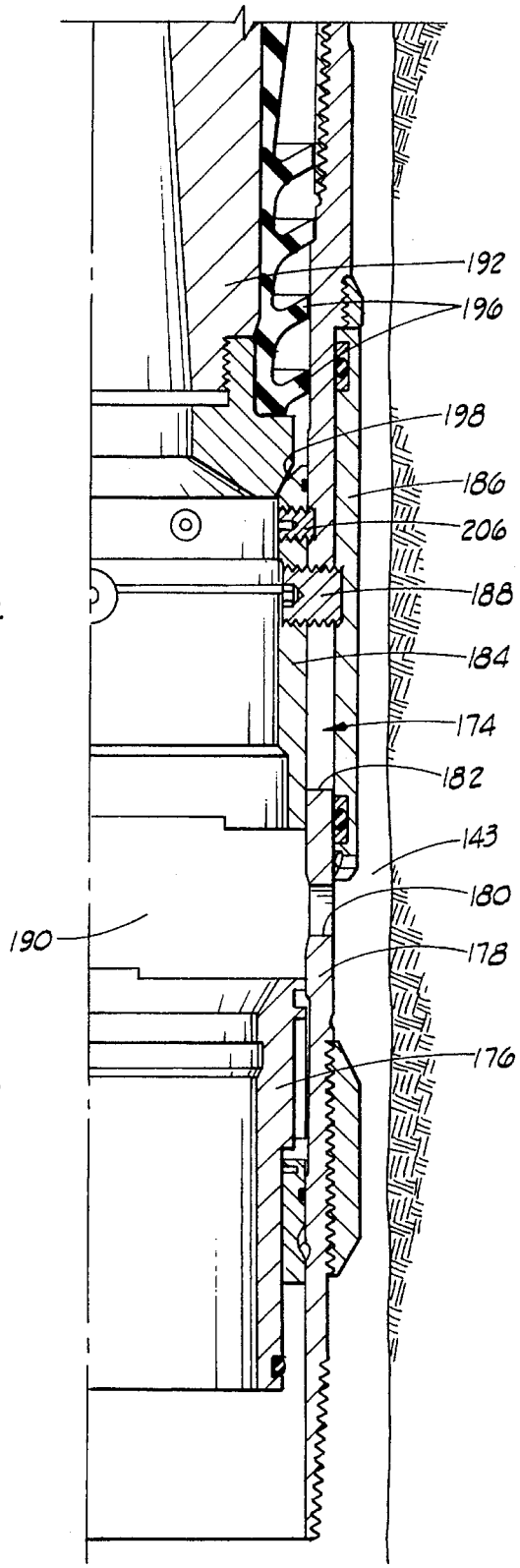

Referring now to FIGS. 5A and 5B, a third embodiment of the apparatus for downhole injection and mixing of fluids into a cement slurry of the present invention is shown as a casing string portion generally designated by the numeral 170. Casing string portion 170 is part of a casing string 172. Casing portion 170 is substantially identical to that in the second embodiment of FIGS. 4A and 4B and includes a bag 132 in a chamber 128 defined by case 116 and mandrel 118 of housing 114. Vent tube 130 connects chamber 128 with well annulus 141.

A solenoid valve 134 controlled by a microprocessor 136, and connected thereto by a connector 137, may be opened to place cavity 138 in bag 132 in communication with well annulus 140 defined between casing string 72 and wellbore 142. The only difference in the apparatus of the second and third embodiments is that the third embodiment includes a cementing valve 174 rather than casing shoe 122. Cementing valve 174 is of a kind known in the art and includes an opening sleeve 176 slidably disposed within a body 178 defining a cementing port 180 therein. Above cementing port 180 is a slot 182. A closing sleeve 184 is disposed above opening sleeve 176 and is connected to an outer sleeve 184 by a pin 188 extending through slot 182.

In FIG. 5B, opening sleeve 176 has already been moved downwardly to an open position to provide communication between a central opening 190 of cementing valve 176 and well annulus 143. Opening sleeve 176 is opened by applying pressure to central opening 190 in a manner known in the art. The portion of casing string 172 below cementing valve 174 is closed during the cementing operation in a manner known in the art.

Once the desired amount of cement has been pumped, an intermediate plug 192 is pumped downwardly. A diaphragm 194 insures that a pressure differential is maintained across bottom plug 192, and wiper rings 196 wipe the inner surface of casing string 172 as plug 192 is pumped downwardly.

Eventually, the lower end of plug 192 engages a seat 198 on closing sleeve 184. Additional pressure applied to plug 192 will rupture diaphragm 194 so that cement passes downwardly through the plug 192 and central opening 190 of cementing valve 174 and thus through cementing port 180 into well annulus 140.

As plug 192 lands, microprocessor 136 senses a signal indicating the presence of plug 192 and opens solenoid valve 134 to allow the accelerant in chamber 138 of bag 132 (and thus in chamber 128) to flow out into the well annulus and mix with the cement therein. As in the second embodiment, a venturi effect is created and/or pressure in cavity 138 or chamber 128 is used to cause the first fluid to flow out into the cement slurry. As before, a piston can be used instead of bag 132.

When the desired amount of cement has been pumped, a top plug 200 is pumped down. Wiper rings 202 on top plug 200 wipe the cement from the interior surface of casing string 172 as the top plug moves downwardly. Eventually, top plug 200 engages the upper end of bottom plug 192. Top plug 200 has a solid upper end 204 so that, as additional pressure is applied above the top plug, the top plug and bottom plug 192 will force closing sleeve 184 in cementing valve 174 to be moved downwardly and thereby shearing shear pin 206. Because closing sleeve 184 is connected to outer sleeve 186 by pin 188, the outer sleeve is moved downwardly to sealingly close cementing ports 180 to terminate the cementing operation.

It will be seen that in each of the embodiments, the accelerant in the cavity in the housing is mixed with the cement slurry at a time and location as desired. Thus, it will be seen that the apparatus for downhole injection and mixing of fluids into a cement slurry of the present invention is well adapted to carry out the ends and advantages mentioned, as well as those inherent therein. While presently preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. An apparatus for injecting fluid into a wellbore, said apparatus comprising:

housing means for defining a chamber therein and a port in communication with said chamber, said chamber being adapted for holding a first fluid therein;

wherein said housing means is characterized by a housing of a plug which may be pumped down the wellbore;

valve means for opening said port such that said first fluid is free to flow out of said chamber through said port in response to a flow of a second fluid thereby;

wherein said housing defines a flow passage through which said second fluid may be flowed, said first fluid flows into said flow passage when said port is opened by said valve means; and wherein a portion of said valve means extends below said housing means such that when said valve means engages a surface therebelow, said valve means is forced upwardly to open said port.

2. The apparatus of claim 1 wherein said port includes having an orifice disposed therein.

3. The apparatus of claim 1 further comprising volume reduction means for reducing a volume of said chamber as said first fluid flows through said port wherein said volume reduction means is characterized by an inflatable bag disposed in said chamber and in communication with said port.

4. The apparatus of claim 1 further comprising volume reduction means for reducing a volume of said chamber as said first fluid flows through said port wherein said volume reduction means is characterized by a piston slidably disposed in said chamber and movable in response to a pressure differential thereacross.

5. The apparatus of claim 1 wherein said valve means comprises a valve sleeve disposed on said housing means and movable from a first position covering said port and a second position wherein said port is uncovered.

6. The apparatus of claim 5 further comprising shearing means for shearably holding said valve sleeve in said first position.

7. The apparatus of claim 1 wherein said first fluid is a cement accelerant.

8. A plug for use in a well cementing operation, said plug comprising:

a housing defining a flow passage disposed therethrough and a fluid holding chamber therein, said housing further defining a port between said flow passage and said fluid holding chamber;

a valve disposed in said housing and movable between a first position closing said port and a second position opening said port such that a first fluid held in said chamber will flow through said port into said flow passage in response to a flow of a second fluid through said flow passage; and wherein a portion of said valve extends below said housing such that when said valve engages a surface therebelow, said valve is forced upwardly to said second position.

9. The plug of claim 8 further comprising an elastomeric bag disposed in said chamber and in communication with said port, said bag being initially filled with said first fluid and collapsible in response to a pressure differential thereacross.

10. The plug of claim 8 further comprising a piston slidably disposed in said chamber such that said chamber is divided into an upper chamber portion and a lower chamber portion, said lower chamber portion being filled with said first fluid;

whereby, said piston moves to reduce a volume of said second chamber portion in response to a differential pressure across said piston.

11. The plug of claim 8 wherein said valve is held in said first position by a shear pin.

12. An apparatus for injecting fluid into a wellbore, said apparatus comprising:

a housing means characterized by a housing of a plug which may be pumped down the wellbore, said housing means defining a flow passage disposed therethrough and a fluid holding chamber therein;

said housing means further defining a port between said flow passage and said fluid holding chamber;

a valve disposed in said housing means and movable between a first position closing said port and a second position opening said port such that a first fluid held in said chamber will flow through said port into said flow passage in response to a flow of a second fluid through said flow passage; and wherein a portion of said valve extends below said housing means such that when said valve engages a surface therebelow, said valve is forced upwardly to said second position.

13. The apparatus of claim 12 wherein said port includes having an orifice disposed therein.

14. The apparatus of claim 12 wherein said valve includes a valve sleeve disposed on said housing means and movable from a first position covering said port and a second position wherein said port is uncovered.

15. The apparatus of claim 14 further comprising shearing means for shearably holding said valve sleeve in said first position.

16. The apparatus of claim 12 wherein said valve is held in said first position by a shear pin.

17. The apparatus of claim 12 wherein said first fluid is a cement accelerant.

18. The apparatus of claim 12 further comprising volume reduction means for reducing a volume of said chamber as said first fluid flows through said port.

19. The apparatus of claim 18 wherein said volume reduction means includes a bag disposed in said chamber and in communication with said port, said bag being initially filled with said first fluid and collapsible in response to a pressure differential thereacross.

20. The apparatus of claim 18 wherein said volume reduction means includes a piston slidably disposed in said chamber and movable in response to a pressure differential thereacross.

* * * * *